US011512489B2

(12) United States Patent
Duffaut

(10) Patent No.: US 11,512,489 B2
(45) Date of Patent: Nov. 29, 2022

(54) SYSTEMS AND METHODS OF OPERATING AUTOMATIC SWIMMING POOL CLEANERS WITH ENHANCED CYCLE TIMES

(71) Applicant: Zodiac Pool Care Europe, Bron (FR)

(72) Inventor: Simon Duffaut, Castelginest (FR)

(73) Assignee: ZODIAC POOL CARE EUROPE, Belberaud (FR)

( * ) Notice: Subject to any disclaimer, the term of this patent is extended or adjusted under 35 U.S.C. 154(b) by 102 days.

(21) Appl. No.: 16/939,191

(22) Filed: Jul. 27, 2020

(65) Prior Publication Data

US 2021/0040760 A1 Feb. 11, 2021
US 2021/0317674 A9 Oct. 14, 2021

Related U.S. Application Data

(60) Provisional application No. 62/883,750, filed on Aug. 7, 2019.

(51) Int. Cl.
*E04H 4/16* (2006.01)

(52) U.S. Cl.
CPC ..... *E04H 4/1654* (2013.01); *E04H 4/16* (2013.01); *E04H 4/1636* (2013.01)

(58) Field of Classification Search
CPC ..... E04H 4/16; E04H 4/1654; E04H 4/1636
See application file for complete search history.

(56) References Cited

U.S. PATENT DOCUMENTS

2003/0085183 A1* 5/2003 Mathews ..... E04H 4/169 210/767
2013/0152316 A1* 6/2013 Rief ..... E04H 4/1654 15/1.7
2016/0145884 A1* 5/2016 Erlich ..... E04H 4/1636 15/1.7
2019/0243379 A1† 8/2019 Attar

FOREIGN PATENT DOCUMENTS

| | | |
|---|---|---|
| EP | 3093413 | 11/2016 |
| EP | 3438380 | 2/2019 |
| WO | 2007047827 | 4/2007 |
| WO | 2017129884 | 8/2017 |

OTHER PUBLICATIONS

International Application No. PCT/IB2020/057078, Invitation to Pay Additional Fees and Where Applicable Protest Fee mailed on Oct. 29, 2020, 9 pages.
International Application No. PCT/IB2020/057078, International Search Report and Written Opinion dated Dec. 21, 2020.
International Application No. PCT/IB2020/057078, International Preliminary Report on Patentability dated Feb. 17, 2022, 10 pages.

* cited by examiner
† cited by third party

*Primary Examiner* — Michael D Jennings
(74) *Attorney, Agent, or Firm* — Kilpatrick Townsend & Stockton LLP

(57) ABSTRACT

A swimming pool cleaner may operate within a pool during a cleaning cycle. The duration of the cleaning cycle may be tailored, or optimized, for the pool by determining a maxi- (Continued)

FLUIDRA

CONCEPT

Cleaning cycle is a chain of patterns.
Patterns are repetitions of sequences.

Sequences are composed by following phases :

- Wall research
- Wall management
- Wall extraction
- Rotation

Sequence template

Every wall research phase duration (between rotation and wall detection) is measured.
Maximal duration is recorded and called maximal length.
This maximal length tracking is compatible with all pattern when they integrate a wall research phase.

Maximal length is a picture of pool size.
Cleaner uses this data to determine an optimal duration to clean the pool.

Optimal duration = Maximal length recorded * Coefficient + Offset

The optimal duration accuracy can be improved by the rotation duration tracking :
Every rotation phase duration is measured. According to every angle instruction and rotation duration, cleaner is able to deduce a rotation speed average.
This rotation speed average is a picture of pool grip.
It can be considered in the calculation of optimal duration.

mum length of time between, for example, a rotation of the cleaner and when it next detects a wall of the pool during a designated interval. As another example, deducing information relating to rotation speed of the cleaner also may be useful in determining the tailored cleaning cycle.

6 Claims, 2 Drawing Sheets

FLUIDRA

CONCEPT

Cleaning cycle is a chain of patterns.
Patterns are repetitions of sequences.

Sequences are composed by following phases :

- Wall research
- Wall management
- Wall extraction
- Rotation

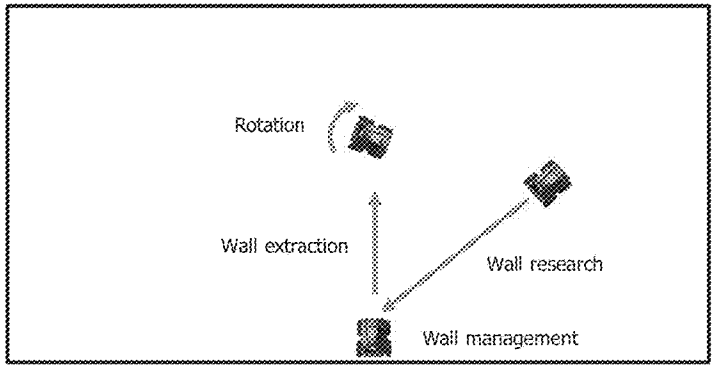

Sequence template

Every wall research phase duration (between rotation and wall detection) is measured.
Maximal duration is recorded and called maximal length.
This maximal length tracking is compatible with all pattern when they integrate a wall research phase.

Maximal length is a picture of pool size.
Cleaner uses this data to determine an optimal duration to clean the pool.

Optimal duration = Maximal length recorded * Coefficient + Offset

The optimal duration accuracy can be improved by the rotation duration tracking :
Every rotation phase duration is measured. According to every angle instruction and rotation duration, cleaner is able to deduce a rotation speed average.
This rotation speed average is a picture of pool grip.
It can be considered in the calculation of optimal duration.

FIG. 1

SYSTEMS AND METHODS OF OPERATING AUTOMATIC SWIMMING POOL CLEANERS WITH ENHANCED CYCLE TIMES

CROSS-REFERENCE TO RELATED APPLICATION

This application claims the benefit of and priority to U.S. Provisional Patent Application Ser. No. 62/883,750, filed Aug. 7, 2019, the entire contents of which are hereby incorporated herein by this reference.

FIELD OF THE INVENTION

This invention relates to cleaning devices for water-containing vessels such as swimming pools and spas and more particularly, although not necessarily exclusively, to autonomous swimming pool cleaners whose cleaning cycle times may be enhanced, if not optimized, based on information obtained during operation within pools.

BACKGROUND OF THE INVENTION

Automatic swimming pool cleaners (APCs) are well known. These cleaners often are categorized as either "hydraulic" or "robotic" (or "electric"), depending on the source of their motive power. Hydraulic cleaners, for example, typically use pressurized (or depressurized) water to effect their movement within pools, whereas robotic cleaners typically utilize an electric motor to cause their movement. Moreover, hydraulic cleaners frequently are sub-categorized as either "pressure-side" or "suction-side" devices, with pressure-side cleaners receiving pressurized water output from an associated water-circulation pump and suction-side cleaners, by contrast, being connected to an inlet of the pump.

Electric motors of robotic cleaners may drive wheels, tracks, or any other suitable mechanisms. Robotic cleaners normally include on-board electronic controls and memory and may transmit and receive information electronically via wire or wirelessly. They thus are capable of being programmed to perform certain tasks and movements within pool. As well, such programs may be updated or changed as appropriate or desired.

Consequently, a robotic APC initially may be programmed to operate within a swimming pool for a designated period of time, called a "cleaning cycle." During this cleaning cycle the robotic cleaner will move, as programmed, within the pool and vacuum debris suspended in the water of the pool. Ideally, the robotic cleaner will traverse at least the entire floor or bottom of the swimming pool during a cleaning cycle. If the robot is configured to climb vertically-oriented pool walls and clean the waterline of the pool, these feats too ideally may be accomplished during a cleaning cycle.

One difficulty with these ideals is that dimensions of swimming pools often are unknown to the robotic cleaners operating therein. As a result, initial programming of a cleaning cycle may be based on generic information and thus not optimized (or otherwise tailored) to a size of a particular pool. If a cleaning cycle is of duration insufficient to allowing cleaning of major surfaces of a pool, the pool may continue to appear to be dirty. By contrast, if a cleaning cycle is of longer duration than needed to clean the major surfaces, energy and operational life of the robotic APC may be wasted.

BRIEF DESCRIPTION OF THE DRAWINGS

FIG. 1 illustrates exemplary aspects of a cleaning cycle of an APC.

DESCRIPTION OF THE INVENTION

Figure 2:
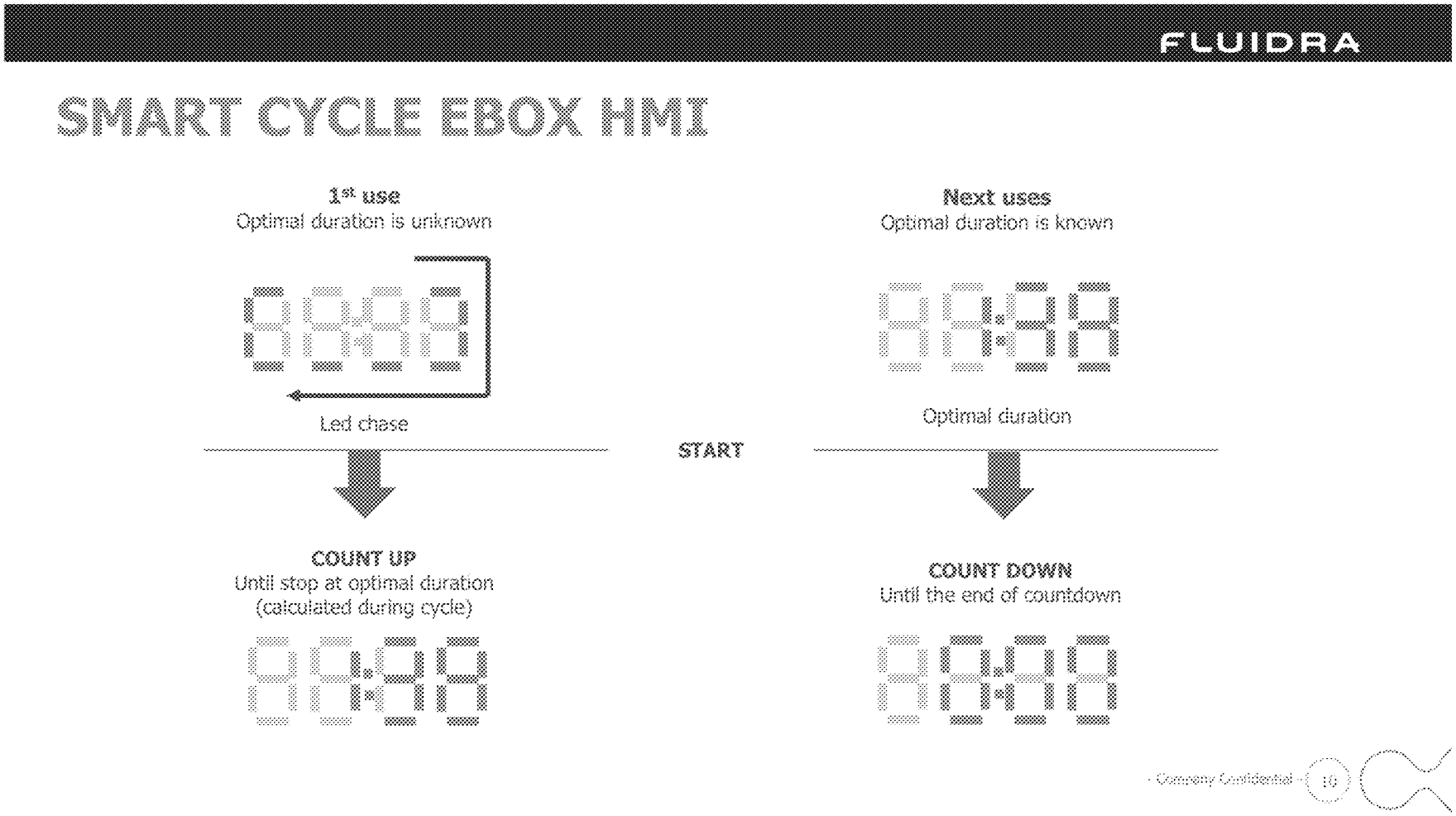
FIG. 2 illustrates exemplary displays that may be provided to a user or pool owner, for example.

The present invention seeks to optimize, or at least enhance, cleaning cycles for robots operating within individual pools. This enhancement may occur by determining amounts of time elapsed as a robotic cleaner accomplishes certain actions within a pool. The elapsed times then may be used to calculate a new cycle time for the pool. Such new cycle time will be based on information obtained through operation in a particular pool and hence tailored, or customized to that pool.

As noted in FIG. 1, a cleaning cycle may be considered as a chain of patterns. Patterns, in turn, may be repetitions of sequences. And sequences themselves may be composed of phases of operation such as (1) wall research, (2) wall management, (3) wall extraction, and (4) rotation.

Rotation of an APC refers to the cleaner changing direction while travelling along the bottom of the pool. Changes of direction may be programmed into the controller or occur as a result of a cleaner encountering obstacles or impediments in the pool. (As one or many possible examples, a robotic APC may rotate upon contact with a main drain projecting upward from a pool bottom.)

Wall management identifies periods when a robotic cleaner is travelling (either up or down) a generally vertically-oriented wall. Although such travels may assist a cleaner in determining a depth of the pool, they are not especially relevant to determine a length or width of the pool. Wall extraction, further, refers to periods during which the robot is transitioning from climbing up or down a vertical wall to travelling along the generally horizontal floor or bottom of the pool.

Wall research, finally, may denote periods of time between rotations and wall detections (leading either to wall management or wall extraction). During a cleaning cycle, the time required for each wall research phase to occur may be recorded. Of particular interest may be the largest (maximum) such time recorded; for purposes of understanding the invention, that largest recorded wall research time during the cleaning cycle may be called the "maximal length."

In some respects, this maximal length serves as an indicator of pool size or area. It may be used to calculate an optimal, or tailored, duration for future cleaning cycles for the pools. Expressed generally, the calculation may be:

$$\text{Cleaning cycle} = \text{Maximal Length} * \text{coefficient} + \text{offset}$$

In other cases this "maximal length" need not be the largest recorded wall research time. Instead, a duration between two waterline scrubbing phases, for example, may be recorded and used. Indeed, significant is only that a duration between two limits is identified, whether these limits are based on phases of a cleaning pattern, physical detection within a pool, or both.

Likewise, the time required for each rotation of the robotic cleaner during a cleaning cycle may be recorded. Respecting each angle instruction and rotation duration, an average rotation speed may be calculated. The average rotation speed may be a proxy for the "grip," or coefficient of friction, of the bottom surface of the pool and potentially used in the cleaning cycle calculation as well. Alternatively or additionally, one or more maximum or minimum rotation speeds, or some other information relating to rotation of the cleaner, may be used. Yet further, depth information of the cleaner could be recorded and included in the cleaning cycle calculation. Water temperature or other sensor data (from, e.g., gyroscopes, accelerometers, magnetos, etc.) could be utilized as well.

FIG. 2 illustrates examples of displays that may be provided to a user or pool owner. Initially, as shown in the upper left block, no optimal cleaning cycle is yet known for the pool. As the robot operates in the pool, a cleaning cycle tailored for the pool may be calculated, and the display may count upward until stopping at the end of the cycle (as shown in the lower left block).

Thereafter, as the optical cleaning cycle is now known, it may be displayed (as depicted in the upper right block). As the cleaner operates in the pool, the display may decrement the time counter to zero (see the lower right block). Persons skilled in the art will, of course, recognize that these displays are not necessary for practicing concepts of the invention or that, if used, need not necessarily be consistent with the blocks of FIG. 2.

Exemplary concepts and combinations of features of the invention may include:

A. A method of defining a cleaning cycle of an automatic swimming pool cleaner operating within a swimming pool by determining the largest duration of time between two occurrences during a particular time interval.

B. A method according to statement A. in which at least one of the two occurrences involves either a phase of a cleaning cycle or detection of a physical object or portion of the swimming pool.

C. A method according to statement A. in which at least one of the two occurrences is selected from the group consisting of (i) a rotation of the cleaner, (ii) a detection by the cleaner of a wall of the swimming pool, (iii) a scrubbing of a waterline of the swimming pool by the cleaner, (iv) a transition of the cleaner from climbing up or down a generally vertical wall of the swimming pool to travelling along a generally horizontal floor or bottom of the swimming pool, or (v) a travelling by the cleaner up or down the generally vertical wall of the swimming pool.

D. A method of defining a cleaning cycle of an automatic swimming pool cleaner operating within a swimming pool by determining information concerning a rotation speed of the cleaner during a particular time interval.

E. A method of defining a cleaning cycle of an automatic swimming pool cleaner operating within a swimming pool by determining both (i) the largest duration of time between a rotation of the cleaner and its detection of a wall of the swimming pool during a particular time interval and (ii) the average rotation speed of the cleaner during a particular time interval.

These examples are not intended to be mutually exclusive, exhaustive, or restrictive in any way, and the invention is not limited to these example embodiments but rather encompasses all possible modifications and variations within the scope of any claims ultimately drafted and issued in connection with the invention (and their equivalents). For avoidance of doubt, any combination of features not physically impossible or expressly identified as non-combinable herein may be within the scope of the invention.

The foregoing is provided for purposes of illustrating, explaining, and describing embodiments of the present invention. Modifications and adaptations to these embodiments will be apparent to those skilled in the art and may be made without departing from the scope or spirit of the invention. Additionally, the word "pool" and phrase "swimming pool" as used herein may include vessels such as spas and hot tubs within their definitions.

What is claimed is:

1. A method of defining a cleaning cycle of an automatic swimming pool cleaner operating within a swimming pool by determining the largest duration of time between two occurrences of a predetermined event during a particular time interval and defining a future cleaning cycle for the automatic swimming pool cleaner based on the largest duration.

2. A method according to claim 1 in which at least one of the two occurrences involves either a phase of a cleaning cycle or detection of a physical object or portion of the swimming pool.

3. A method according to claim 1 in which at least one of the two occurrences is selected from the group consisting of (i) a rotation of the cleaner, (ii) a detection by the cleaner of a wall of the swimming pool, (iii) a scrubbing of a waterline of the swimming pool by the cleaner, (iv) a transition of the cleaner from climbing up or down a generally vertical wall of the swimming pool to travelling along a generally horizontal floor or bottom of the swimming pool, or (v) a travelling by the cleaner up or down the generally vertical wall of the swimming pool.

4. A method according to claim 1, wherein the predetermined event comprises at least one of a physical detection within a pool or a cleaning pattern.

5. A method of defining a cleaning cycle of an automatic swimming pool cleaner operating within a swimming pool by determining information concerning an average rotation speed of the cleaner during a particular time interval and defining the cleaning cycle based on the determined information concerning the average rotation speed of the cleaner.

6. A method of defining a cleaning cycle of an automatic swimming pool cleaner operating within a swimming pool by determining both (i) the largest duration of time between a rotation of the cleaner and its detection of a wall of the swimming pool during a particular time interval and (ii) the average rotation speed of the cleaner during a particular time interval.

* * * * *